United States Patent [19]

Carter

[11] Patent Number: 4,782,757

[45] Date of Patent: Nov. 8, 1988

[54] FUSE ASSEMBLY FOR MILITARY PROJECTILE

[75] Inventor: Harry R. Carter, Moscow, Pa.

[73] Assignee: Carter Research and Development Technological Systems Incorporated, Moscow, Pa.

[21] Appl. No.: 95,151

[22] Filed: Sep. 11, 1987

[51] Int. Cl.[4] ..... F42B 13/24; F42C 15/04; F42C 15/34

[52] U.S. Cl. ..... 102/394; 102/252; 102/445; 102/254

[58] Field of Search ..... 102/372, 373, 379, 394, 102/529, 445, 252, 222, 247, 251, 253, 254, 272, 260

[56] References Cited

U.S. PATENT DOCUMENTS

| | | | |
|---|---|---|---|
| 1,235,637 | 8/1917 | Barlow | 102/394 |
| 2,118,062 | 5/1938 | Woodberry | 102/251 |
| 2,870,713 | 1/1959 | Saloranta et al. | 102/251 |
| 2,938,463 | 5/1960 | Jasse | 102/253 |
| 2,999,461 | 9/1961 | Apothéloz et al. | 102/253 |
| 3,343,488 | 9/1967 | Sherwood | 102/372 |
| 3,611,942 | 10/1971 | Popper | 102/222 |
| 3,744,424 | 7/1973 | Popper et al. | 102/251 |
| 3,968,748 | 7/1976 | Burford et al. | 102/394 |
| 4,007,689 | 2/1977 | Apothéloz | 102/251 |

FOREIGN PATENT DOCUMENTS

| | | | |
|---|---|---|---|
| 705507 | 4/1941 | Fed. Rep. of Germany | 102/252 |

OTHER PUBLICATIONS

Letter dated 8/2/85 from A. E. Framerin; with attachments p. 309 (bouncing betty) and pages V11-13 to 15 on German mortars.

Drawing of production fuse sold under government contract to U.S. Army.

*Primary Examiner*—David H. Brown

*Attorney, Agent, or Firm*—David A. Tamburro

[57] ABSTRACT

A compact, self-contained fuse assembly for producing a near surface burst of a military projectile such as a mortar shell.

31 Claims, 3 Drawing Sheets

12
68
66
70
60
16
24
76
62
22
132
14
130
40

FULLY ARMED
ARMED STRIKER LOCKED OUT
12
BURST
BLOW BACK
GROUND STRIKE
142

FUSE ASSEMBLY FOR MILITARY PROJECTILE

BACKGROUND OF THE INVENTION

This invention relates generally to a point detonating fuse for high explosive mortar ammunition, and more particularly to a fuse which upon target impact will produce a near surface burst of the mortar shell, thereby, maximizing the fragmentation dispersal and increasing the lethality of the shell.

Current mortar ammunition often is ineffective because it bursts essentially at ground level with minimum fragmentation dispersal. Intensive, costly development has been directed toward improving the effectiveness of mortar ammunition, and toward this end, expensive proximity and time controlled fuses have been proposed to produce a near surface burst at about 3 to 8 feet above the target surface.

Proximity fuses commonly employ complicated electronic sensing devices intended to sense approaching target areas. However, they are seriously affected by conditions such as climate, rain, sleet, snow, tree foilage, and vegetation. Hence, the fuses often are triggered prematurely or late, or not at all, thus rendering the mortar shells ineffective.

Time fuses require a gun crew to estimate target range and then equate it to time within a tenth of a second setting on the fuse clock controls. Many variables affect flight time of a round, such as variation in weight, propellant powder, clearances between the round and bore of the barrel, in-flight conditions such as air density, temperature, wind, etc., any of which may cause an early or late burst based solely on time.

Some years ago the German Army proposed a mortar shell known as the "Bouncing Betty" in which, upon impact, a nondelay fuse assembly was intended to ignite a powder charge to throw the shell into the air before the main charge was detonated. However, apparently because of poor design, this proposal proved unsuccessful and was abandoned.

OBJECTS OF THE INVENTION

Accordingly, the primary object of this invention resides in the provision of a novel fuse assembly for high explosive mortar ammunition that will upon target impact produce a near surface burst of the round, e.g. 3 to 8 feet above the ground.

Another object of the invention resides in the provision of novel point detonating fuse assembly for use with a mortar round, wherein the fuse assembly satisfies all military safety requirements for handling, transportation, weapon, and gun crew safety.

Still another object of the invention resides in the provision of the above novel fuse assembly which includes a blowback chamber and cartridge that, following impact of the fuse function in the nature of a gun barrel to aim and direct the mortar round back up into the air at substantially the same angle as the angle of target impact.

A further object of the invention resides in the provision of the above novel fuse assembly which is mechanically simple in construction and inexpensive to manufacture, but yet is reliable in operation to produce a desirable and acceptable high rate of near surface bursts.

Other objects and advantages of the invention will become apparent from reading the following detailed description of the invention wherein reference is made to the accompanying drawing in which like numerals indicate like elements.

DETAILED DESCRIPTION OF THE INVENTION

Figures 1, 2:
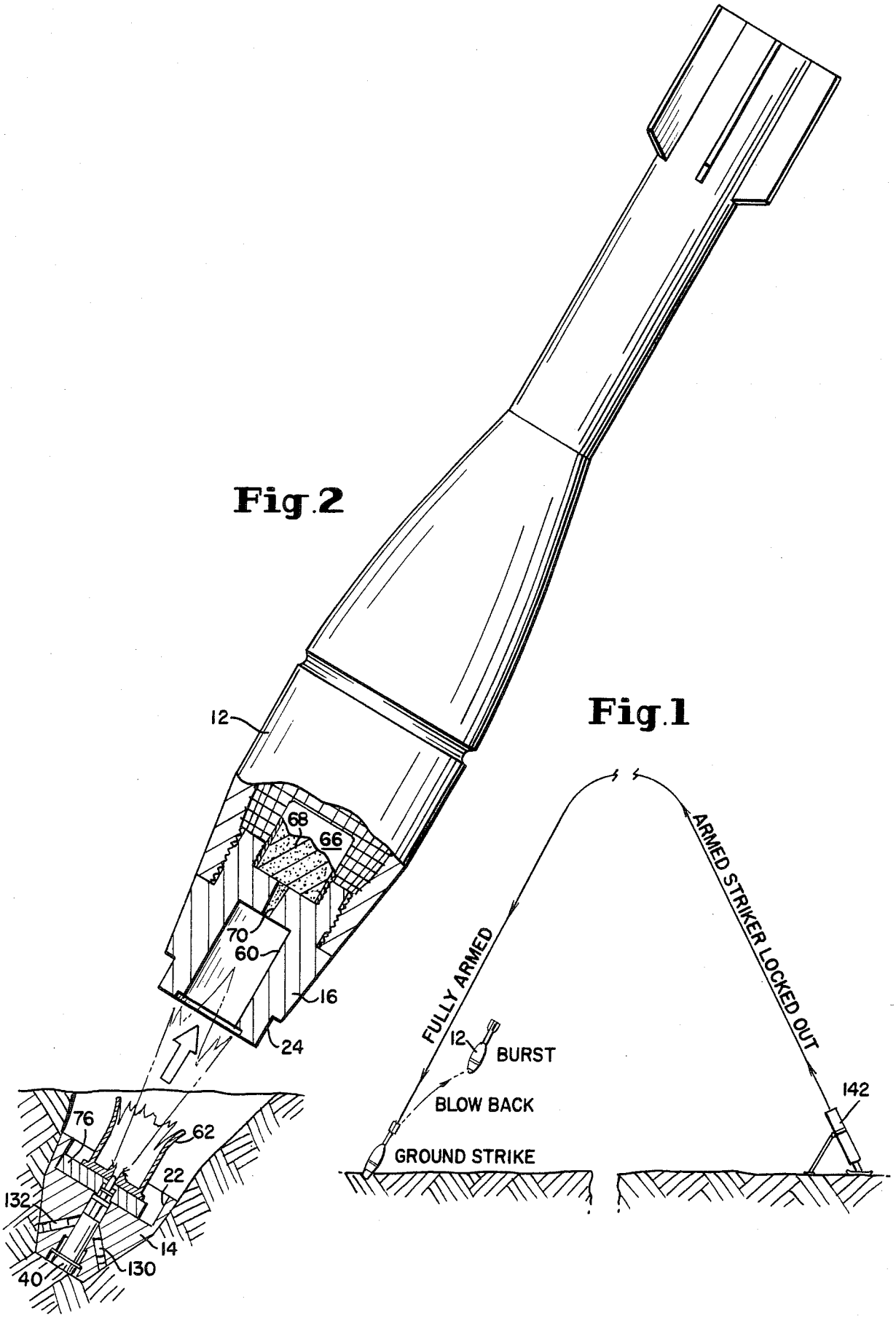
FIG. 1 is a fragmentary perspective view of a mortar round incorporating the novel blowback fuse of the invention to produce a near surface burst.
FIG. 2 is an enlarged fragmentary sectional view of the novel fuse assembly of the invention at time of impact.
Figure 4:
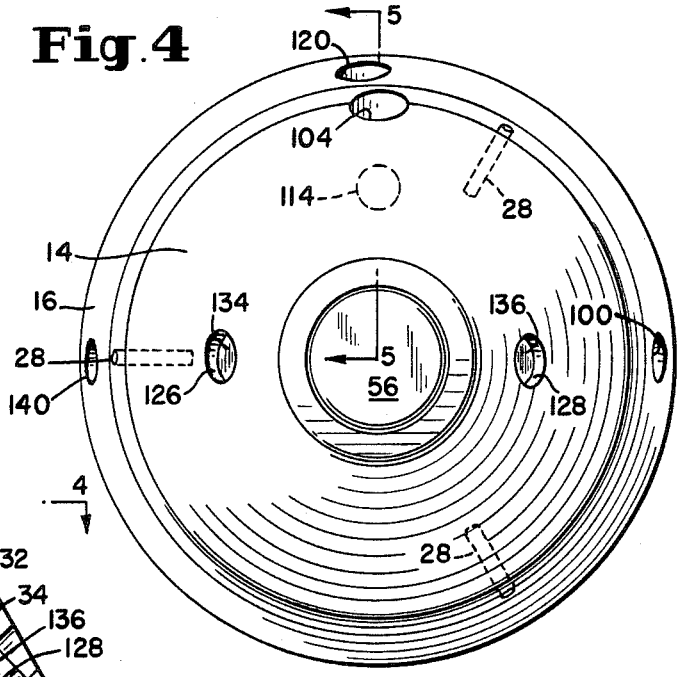
FIG. 4 is a top view taken generally along line 4—4 of FIG. 3.

Referring now to FIGS. 1 and 2 of the drawings, the novel point detonating blowback fuse assembly 10 of the invention, when mounted on a mortar round 12, upon impact causes the round to be thrown upwardly into the air about 3 to 10 feet to produce a desirable near surface burst and thereby maximize fragmentation dispersal.

Figure 3:
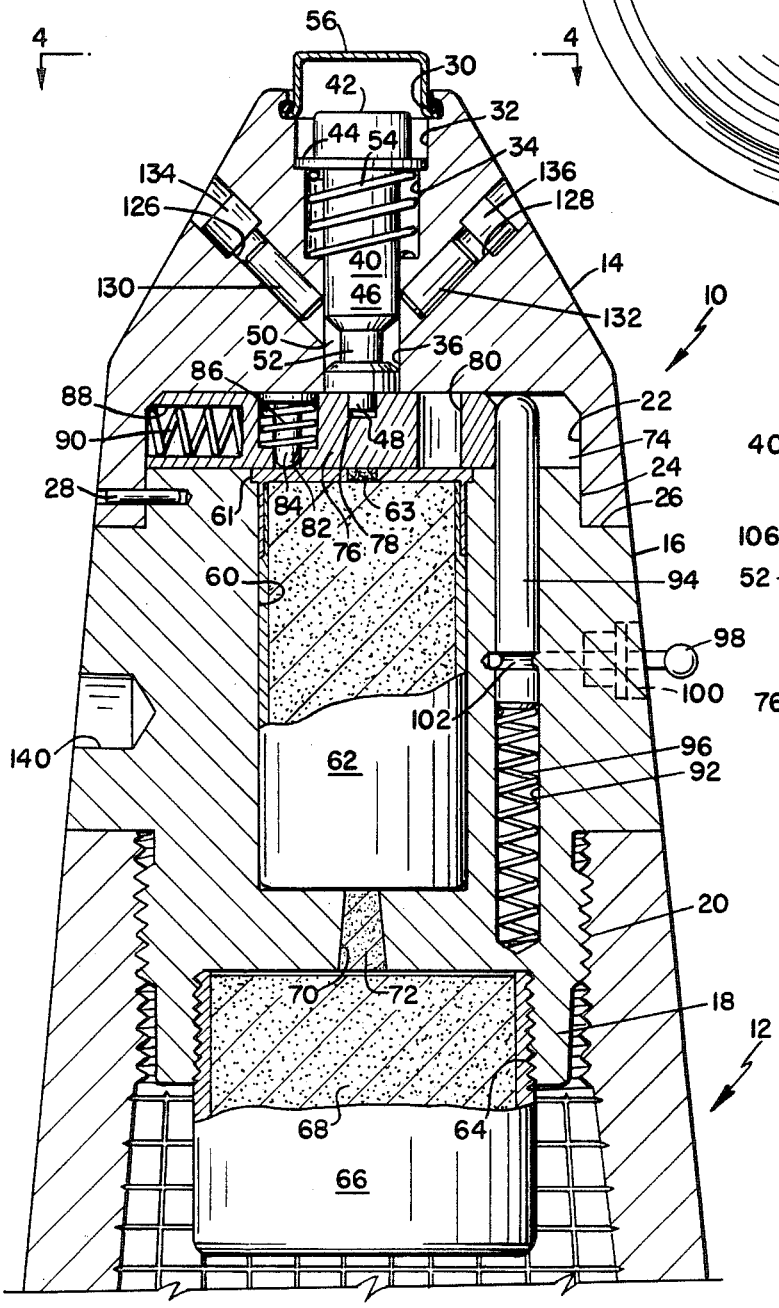
FIG. 3 is a fragmentary sectional elevational view of the fuse assembly of the invention illustrating the firing pin, slide mechanism, and slider set back pin in a safe, unarmed condition.
Figure 5:
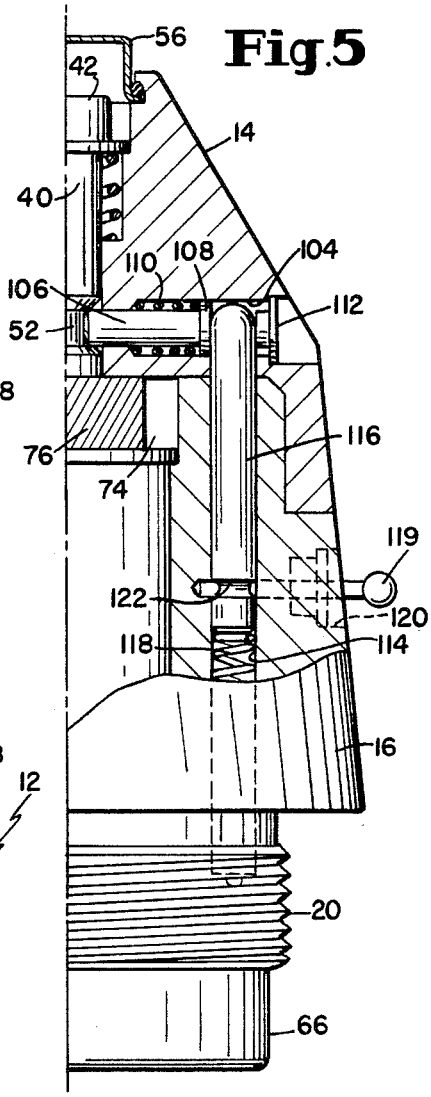
FIG. 5 is a fragmentary sectional elevational view taken generally along Line 5—5 of FIG. 4 and illustrating the striker the striker slider pin, and striker setback pin in a safe, unarmed condition.

As shown in FIGS. 3 and 5, fuse assembly 10 is of a two-piece separable body construction and includes a front ogival nose section 14 and a rearward body section 16 having a reduced diameter rear portion 18 provided with external threads 20 which thread into a mating thread section on mortar shell 12. Section 14 has a large counterbore 22 which receives a reduced turn area 24 on section 16, with both sections coming together at shoulder separation line 26 and being releasably held together by frangible shear pins 28.

Figure 6:
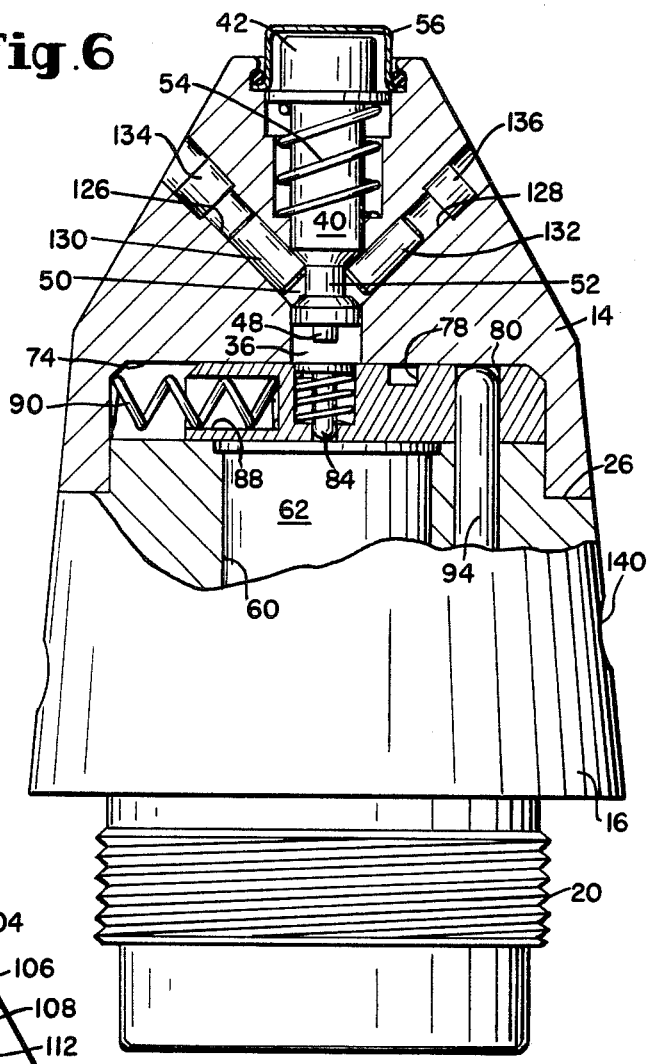
FIGS. 6 and 7 are views similar to FIGS. 3 and 5, respectively, with the respective parts in an armed, striker lock-out condition during upward trajectory of the mortar round after being fired from the gun.

Nose section 14 includes an axial passageway having successively reduced diameter bore areas 30, 32, 34, and 36 which communicates with counterbore 22. Striker pin 40 has an outer impact end 42, enlarged shoulder section 44 slidably fitting in bore area 32, main section 46 slidably fitting in bore area 36, and reduced striker end 48. Section 46 has an annular slot area 50 formed between reduced diameter section 52 and bore section 36. Spring 54 is compressed within bore section 34 and acts against shoulder 44 to normally urge striker 40 toward a forward position (FIG. 6). A thin aluminum windshield 56 snaps into an O-ring groove in bore section 30 and covers striker end 42.

Fuse body section 16 has cylindrical chamber 60 with upper counterbore 61 axially aligned with striker pin 40. Chamber 60 houses a standard cylindrical shotgun cartridge 62 with primer 63, the cartridge providing the blowback charge to shear pins 28 and throw shell 12 into the air. Rear body portion 18 includes an internal threaded bore section 64 which receives the threaded end of booster can 66 that contains an ignition charge 68 to detonate the main explosives within mortar shell 12. A flash hole 70 extends axially between chamber 60 and bore section 64 and contains a pyrotechnic train 72 which is ignited by blowback charge 62 and, in turn, provides a delay in igniting booster charge 68.

Body section 16 at its upper end has a generally rectangular slot 74 extending perpendicularly between striker 40 and chamber 60. A slider stop block 76 is slidably mounted in slot 74 and includes a blind hole 78 for receiving striker end 48, a drilled through hole 80, a drilled and counterbored hole 82 housing a firing pin 84 and spring 86 biasing pin 84 away from cartridge 62, and an end opening 88 housing spring 90 which urges slider block 76 to the right in FIG. 3.

Body section 16 has an elongated opening 92 which extends parallel to its axis and slidably receives slider setback pin 94 and spring 96 that biases pin 94 in a forward position into slot 74. In the unarmed position of FIG. 3, setback pin 94 abuts the right end of slider stop block 76 to hold the block in its safe, unarmed position wherein firing pin 84 is out of alignment with striker 40 and primer 63. A manual safety pin 98 extends into a side opening 100 in body section 16 through a standard pull pin seal and washer retainer and engages within annular groove 102 on pin 92 to lock it in its unarmed position.

As shown in FIG. 5, nose section 14 has a side opening 104 in which striker slider pin 106 slides, the pin having a head 108 against which spring 110 acts to push it outwardly. A plug 112 closes opening 104. In the safe unarmed position of FIG. 5, pin 106 fits within annular slot 50 to hold striker pin 40 in its safe position as shown in FIGS. 3 and 5.

An axially parallel elongated opening 114 is formed in body sections 14 and 16 and receives striker setback pin 116 and spring 118 which biases pin 116 in a forward position. In the safe position of FIG. 5, pin 116 abuts the outer face of head 108 to hold slider pin 106 in its locking position. A manual safety pull pin 119 extends into side opening 120 in body section 16 through a standard pull pin seal and washer retainer and engages within annular groove 122 on pin 116 to lock it in its safe unarmed position of FIG. 5. Pull pins 98 and 119 may be connected to a common lanyard for simultaneous removal.

A pair of openings 126 and 128 are drilled diagonally through nose 14 to intersect bore area 36, and a pair of cylindrical locking stop slugs 130 and 132 are closely slidably mounted within those openings for guided movement in and out of annular groove 50 in response to gravity. Plugs 134 and 136 seal openings 126 and 128 and retain slugs 130 and 132 within.

A plurality of holes 140 in section 16 receive a spanner wrench to tighten fuse assembly 10 within shell 12.

From the description hereinabove it is understood that blowback fuse assembly 10, with pull pins 98 and 119 in place and its other components positioned as in FIGS. 3 and 5, is in a safe unarmed condition and may be readily, safely assembled on mortar shell 12. Similarly, during the storage, handling, and transportation of the assembled fuse assembly and mortar shell, accidental detonation is prevented and safety of military personnel is ensured.

Figure 7:
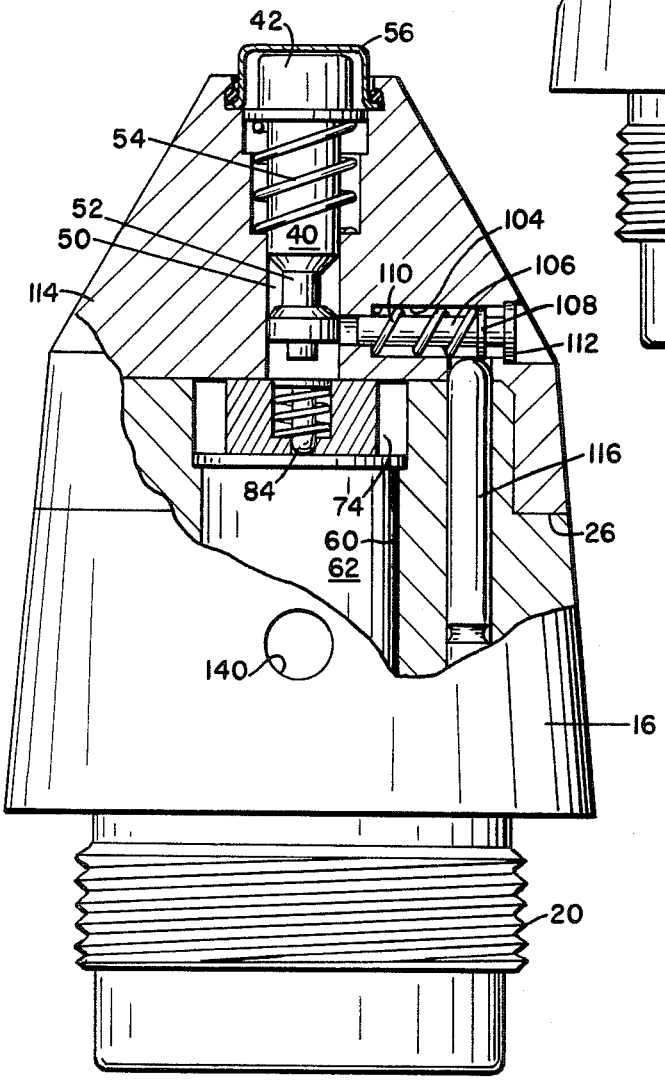

Normal operation of blowback fuse assembly 10 will now be described. As previously noted, the fuse is in its safe unarmed condition with its various components positioned as in FIGS. 3 and 5. Upon removal of pull pins 98 and 119, setback pins 94 and 116 remain in their safe forward positions and retain slider block 76 and striker pin 40 in these safe positions. Shell 12 is then dropped into firing tube 142 and launched in usual fashion at an angle of 45° or more. Upon launch the inertial setback "G" force caused by propulsion retracts both setback pins 94 and 116. Retraction of pin 116 within opening 114 releases slider pin 106 and compressed spring 110 forces pin 106 outwardly away from annular slot 50 to its position of FIG. 7. Striker 40 is then pushed forwardly by spring 54, freeing striker end 48 from hole 78 in block 76. Retraction of setback pin 94 within opening 92 releases slider block 76 and spring 90 forces block 76 to its position of FIG. 6 wherein firing pin 84 is in direct alignment with striker end 48 and primer 63. When the setback pressure normalizes, pin 94 returns to its relaxed position and enters into opening 80 to hold block 76 in its armed position of FIG. 6, and pin 116 engages against head 108 to hold pin 106 in its armed position of FIG. 7.

As striker 40 moves forward, stop slugs 130 and 132 slide inwardly in holes 126 and 128 under gravity into annular groove 50 (FIG. 6) and thereby block striker 40 from engaging firing pin 84. Slugs 130 and 132 remain in their locking position during upward trajectory of shell 12 and after launch provide a safe time period and distance away from the gun crew before the fuse is fully armed. Fuse 10 only becomes fully armed after shell 12 reaches the apex of flight and starts it downward trajectory. In response to gravity and spin of the shell, slugs 130 and 132 slide outwardly and free slider 40 for engagement with firing pin 84 upon impact with the target (FIG. 2).

At impact, striker 40 is driven inwardly and end 48 strikes firing pin 84 which strikes primer 63 to detonate the blowback charge in cartridge 62. Detonation of the blowback charge causes shearing of shear pins 28 and separation of fuse sections 14 and 16, and the blowback force is sufficient to throw shell 12 3 to 8 feet into the air. Detonation of the blowback charge also ignites the pyrotechnics 72 in flash hole 70 which causes a slight delay in igniting ignition charge 68 in booster can 66. This, in turn, detonates the main explosive charge in shell 12 causing a near surface burst.

The cylindrical chamber 60 and cartridge 62 confined therein function as a gun barrel to impart an aimed direction to the blowback force, thus throwing shell 12 back up into the air approximately at the same angle as the angle of target impact.

From the description hereinabove it is apparent that the point detonating fuse assembly of the invention is economical, compact, self-contained and readily attachable as a complete unit to a standard mortar shell. It satisfies all military safety requirements for assembly, handling, transportation, and firing, and dependably functions to provide a near surface burst and thereby enhance the fragmentation dispersal of the shell.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fuse assembly for use in a projectile such as a mortar shell or the like containing a main explosive charge, said assembly comprising body means having a front nose section and a rear section adapted to be connected to a projectile, means releasably connecting said nose and rear sections together, chamber means within said body means adapted to house a blowback charge means, detonating means mounted in said nose section in operative association with said chamber means, stop means mounted within said body means for movement from a safe unarmed position in which it prevents said detonating means from causing detonation of said blowback charge means to an armed position following propulsion of the projectile wherein it permits said detonating means to cause detonation of said blowback charge means, whereby upon impact of said nose section with a target said detonating means causes detonation of the blowback charge means to release said rear section from said nose section and throw said rear section and projectile back up into the air to produce a near surface burst of the projectile.

2. The fuse assembly of claim 1, said rear section including means for containing a booster charge which is ignited by the blowback charge means and in turn detonates the main explosive charge in the projectile.

3. The fuse assembly of claim 2, wherein said detonating means, said chamber means, and said booster charge containing means are substantially axially aligned when said stop means is in its armed position.

4. The fuse assembly of claim 1, said chamber means being substantially cylindrical in shape.

5. The fuse assembly of claim 4 said blowback charge means including a cylindrical cartridge confined within said chamber means, said chamber means and cartridge acting in the projectile of a gun barrel to direct said rear section and shell back up into the air at substantially the same angle as the angle of target impact.

6. The fuse assembly of claim 5, said rear section including means for containing a booster charge which is ignited by the blowback charge means and in turn detonates the main explosive charge in the projectile.

7. The fuse assembly of claim 6, wherein said detonating means, said chamber means, and said booster charge containing means are substantially axially aligned when said stop means is in its armed position.

8. The fuse assembly of claim 1, said detonating means comprising striker means movably mounted within said nose section. in substantial axial alignment with said chamber means, first setback means for normally retaining said striker means in a safe unarmed position but releasing said striker means to an armed position in response to a predetermined inertial force following propulsion of said projectile, stop said means movable from a safe unarmed position in which it prevents said striker means from causing detonation of said blowback charge means to an armed position where it permits detonation, and second setback means for normally retaining said stop means in its safe unarmed position but releasing said stop means to its armed position in response to a predetermined inertial force following propulsion of said projectile.

9. The fuse assembly of claim 8 comprising gravity responsive lockout means for locking said striker means in its armed position during upward trajectory flight of said projectile but freeing said striker means during downward trajectory flight for movement to a detonation position upon impact with a target.

10. The fuse assembly of claim 9, said nose section including axial passage means in which said striker means is slidably mounted, said lockout means including diagonal passage means intersecting said axial passage means and cylindrical stop means slidably mounted in said diagonal passage means for movement into said axial passage means during upward trajectory flight to lock said striker means and out of said axial passage means during downward trajectory flight to free said striker means.

11. The fuse assembly of claim 10, said striker means having an annular groove and said cylindrical stop means being movable in and out of said annular groove.

12. The fuse assembly of claim 8, comprising firing means movable with said stop means from a safe unarmed position to an armed position in which it aligns between said striker means and said chamber means.

13. The fuse assembly of claim 12, said rear section including means for containing a booster charge which is ignited by the blowback charge means and in turn detonates the main explosive charge in the projectile.

14. The fuse assembly of claim 12, said chamber means being substantially cylindrical in shape.

15. The fuse assembly of claim 14 said blowback charge means including a cylindrical cartridge confined within said chamber means, said chamber means and cartridge acting in the nature of a gun barrel to direct said rear section and projectile back up into the air at substantially the same angle as the angle of target impact.

16. A fuse assembly for use in a projectile such as a mortar shell or the like containing a main explosive charge, said assembly comprising body means having a front nose section and a rear section adapted to be connected to a projectile, means releasably connecting said nose and rear sections together, cylindrical chamber means formed within said rear section adapted to house a blowback charge means, striker means movably mounted within said nose section in substantial axial alignment with said chamber means, stop means mounted within said body means for movement fron a safe unarmed position in which it prevents said striker means from causing detonation of said blowback charge means to an armed position in response to a predetermined inertial force following propulsion wherein it permits said striker means to cause detonation of said blowback charge means, said rear section having means for containing a booster charge operatively associated with said chamber means, whereby upon impact of said nose section with a target said striker means causes detonation of the blowback charge means to release said rear section from said nose section and throw the rear section and projectile back up into the air, the booster charge being ignited by the blowback charge means and in turn detonating the main explosive charge in the projectile to produce a near surface burst.

17. The fuse assembly of claim 16 comprising firing means movable with said stop means from a safe unarmed position to an armed position in which it aligns between said striker means and said chamber means.

18. The fuse assembly of claim 16 comprising gravity responsive lockout means for locking said striker means in its armed position during upward trajectory flight of said projectile but freeing said striker means during downward trajectory flight for movement to a detonating position upon impact with a target.

19. The fuse assembly of claim 18, said nose section including axial passage means in which said striker means is slidably mounted, said lockout means including diagonal passage means intersecting said axial passage means and cylindrical stop means slidably mounted in said diagonal passage means for movement into said axial passage means during upward trajectory flight to lock said striker means and out of said axial passage means during downward trajectory flight to free said striker means.

20. The fuse assembly of claim 19, said striker means having an annular groove and said cylindrical stop means being movable in and out of said annular groove.

21. In combination with a projectile containing a main explosive charge, a self-contained fuse assembly comprising body means having a front nose section and a rear section connected to said projectile, means releasably connecting said nose and rear sections together, chamber means formed withi said body means, blowback charge means contained within said chamber means, detonating means mounted in said nose section in operative association with said blowback charge means, stop means mounted within said body means for movement from a safe unarmed position in which it prevents said detonating means from causing detonation of said blowback charge means to an armed position following propulsion of said projectile wherein it permits said detonating means to cause detonation of said blowback charge means, whereby upon impact of said nose section with a target said detonating means causes detonation of said blowback charge means to release said rear section from said nose section and throw said rear section and said projectile back up into the air to produce a near surface burst of said projectile.

22. The combination of claim 21, said rear section including means containing a booster charge which is ignited by said blowback charge means to detonate said main explosive charge.

23. The combination of claim 21, said chamber means being substantially cylindrical in shape and said blowback charge means including a cylindrical cartridge confined within said chamber means, said chamber means and cartridge acting in the nature of a gun barrel to direct said rear section and said projectile back up into the air at substantially the same angle as the angle of target impact.

24. The combination of claim 23, said rear section including means containing a booster charge which is ignited by said blowback charge means and in turn detonates said main explosive charge.

25. The combination of claim 21, said detonating means comprising striker means movably mounted within said nose section in substantial axial alignment with said blowback charge means, first setback means for normally retaining said striker means in a safe unarmed position but releasing said striker means to an armed position in response to a predetermined inertial force following propulsion of said projectile, said stop means movably from a safe unarmed position in which it prevents said striker means from causing detonation of said blowback charge means to an armed position where it permits detonation, and second setback means for normally retaining said stop means in its safe unarmed position but releasing said stop means to its armed position in response to a predetermined inertial force following propulsion of said projectile.

26. The combination of claim 25, comprising firing means movable with said stop means from a safe unarmed position to an armed position in which it aligns between said striker means and said blowback charge means.

27. The combination of claim 26, said rear section including means containing a booster charge which is ignited by said blowback charge means and in turn detonates said main explosive charge.

28. The combination of claim 26, said chamber means being substantially cylindrical in shape and said blowback charge means including a cylindrical cartridge confined within said chamber means, said chamber means and cartridge acting in the nature of a gun barrel to direct said rear section and said projectile back up into the air at substantially the same angle as the angle of target impact.

29. The combination of claim 25 comprising gravity responsive lockout means for locking said striker means in its armed position during upward trajectory flight of said projectile but freeing said striker means during downward trajectory flight for movement to a detonation position upon impact with a target.

30. The combination of claim 29, said nose section including axial passage means in which said striker means is slidably mounted, said lockout means including diagonal passage means intersecting said axial passage means and cylindrical stop means slidably mounted in said diagonal passage means for movement into said axial passage means during upward trajectory flight to lock said striker means and out of said axial passage means during downward trajectory flight to free said striker means.

31. The combination of claim 30, said striker means having an annular groove and said cylindrical stop means being movable in and out of said annular groove.

* * * * *